US005685106A

United States Patent [19]

Shoham

[11] Patent Number: 5,685,106

[45] Date of Patent: Nov. 11, 1997

[54] LASER CARTRIDGE

[75] Inventor: Avi Shoham, Petach Tikva, Israel

[73] Assignee: Ortek Ltd., Sderot, Israel

[21] Appl. No.: 609,814

[22] Filed: Feb. 29, 1996

[51] Int. Cl.[6] ..... F41G 1/34

[52] U.S. Cl. ..... 42/103; 42/100

[58] Field of Search ..... 42/103, 100

[56] References Cited

U.S. PATENT DOCUMENTS

| | | | |
|---|---|---|---|
| 3,631,623 | 1/1972 | Platt | 42/84 |
| 5,119,576 | 6/1992 | Erning | 42/103 |
| 5,272,828 | 12/1993 | Petrick et al. | 42/84 |
| 5,345,707 | 9/1994 | Randall | 42/103 |
| 5,488,795 | 2/1996 | Sweat | 42/103 |

*Primary Examiner*—Charles T. Jordan
*Assistant Examiner*—Meena Chelliah
*Attorney, Agent, or Firm*—Mark M. Friedman

[57] ABSTRACT

A cartridge-shaped laser device that can be loaded into a conventional gun and used for target practice. The device preferably includes an infrared diode laser, a lens to collimate the infrared light emitted by the diode laser, and a generator to supply power to the diode laser when the gun is fired.

15 Claims, 3 Drawing Sheets

LASER CARTRIDGE

FIELD AND BACKGROUND OF THE INVENTION

The present invention relates to a target practice cartridge and, more particularly, to a cartridge that shines a collimated pulse of coherent electromagnetic radiation on a target when a gun loaded with the cartridge is fired.

Acquiring proficiency in the use of firearms requires extensive practice. The most realistic practice, using live ammunition, suffers from the drawback that it is dangerous and noisy.

Over short distances, the trajectory of a bullet is substantially straight, and can be simulated by a beam of coherent electromagnetic radiation. Coherent electromagnetic radiation is silent. Unlike live ammunition, which is hazardous to life and limb, coherent electromagnetic radiation is relatively safe, being harmless even to eyesight at low power levels. Many varieties of gun-shaped lasers are sold commercially to satisfy the demand for a weapon-like device for safe target practice. In addition, accessories such as barrel inserts and extensions are available that can be attached to conventional guns to allow their firing mechanisms to activate sources of coherent electromagnetic radiation such as lasers. Typically, these gun-shaped lasers and laser accessories are fired at targets that emit signals, such as sounds or light flashes, when they are struck by a pulse of coherent electromagnetic radiation.

Neither the gun-shaped lasers nor the laser accessories are totally satisfactory as firearm simulators. A true simulator would have the same shape, weight, balance, and feel as a real gun. A gun-shaped laser is not a real gun, and an accessory attachment to a real gun inevitably changes its handling characteristics.

There is thus a widely recognized need for, and it would be highly advantageous to have, a way to practice shooting firearms, without the noise and danger of live ammunition, while retaining the handling characteristics of the actual firearms loaded with live ammunition.

SUMMARY OF THE INVENTION

According to the present invention there is provided a laser cartridge for a gun that fires an ammunition cartridge, the gun having a firing mechanism, comprising: (a) a rigid housing, substantially the same size and shape as the ammunition cartridge, said housing having a front end; and (b) a source of coherent electromagnetic radiation, contained within said housing.

The device of the present invention is a major advance towards the goal of safe but realistic simulation of target practice with live ammunition. The device is a cartridge, of substantially the same size and shape as an ammunition cartridge, that emits coherent electromagnetic radiation instead of firing a bullet. The device is loaded into a conventional double-action gun in the same way as real ammunition is loaded. When the gun is fired, the cartridge of the present invention emits a pulse of coherent electromagnetic radiation through the barrel of the gun. Thus, the present invention allows the use of real guns in laser target practice, thereby preserving all aspects of the feel of live ammunition except the recoil.

Although the scope of the present invention includes the use of any suitable source of coherent electromagnetic radiation, the preferred source is a laser, especially a diode laser. The electromagnetic radiation may be of any suitable frequency, such as infrared light, visible light, or ultraviolet light. In preferred embodiments of the present invention, the electromagnetic radiation is infrared light.

Preferably, the cartridge is provided with a collimator, such as a lens, to direct the coherent electromagnetic radiation in a substantially parallel beam out the barrel of the gun. This collimator preferably is mounted adjustably within the housing, so that the position of the collimator can be adjusted to ensure that the beam of electromagnetic radiation is emitted along the longitudinal axis of the cartridge.

Preferably, the cartridge of the present invention contains its own power supply, such as a battery or a generator. The preferred power supply is a generator consisting of a coil of wire, a permanent magnet, and a spring. When the gun is fired, the firing pin pushes the magnet through the coil against the spring, inducing electric current in the coil and compressing the spring. Then the spring pushes the magnet in the opposite direction through the coil, inducing an opposite electric current. Thus, unlike an munition cartridge, the cartridge of the present invention is reusable.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is of a laser cartridge which can be used for safe target practice. Specifically, the present invention can be used for target practice with a conventional gun, thereby preserving all aspects of the feel of target practice with live munition except the recoil.

The principles and operation of a laser cartridge according to the present invention may be better understood with reference to the drawings and the accompanying description.

Figure 1:
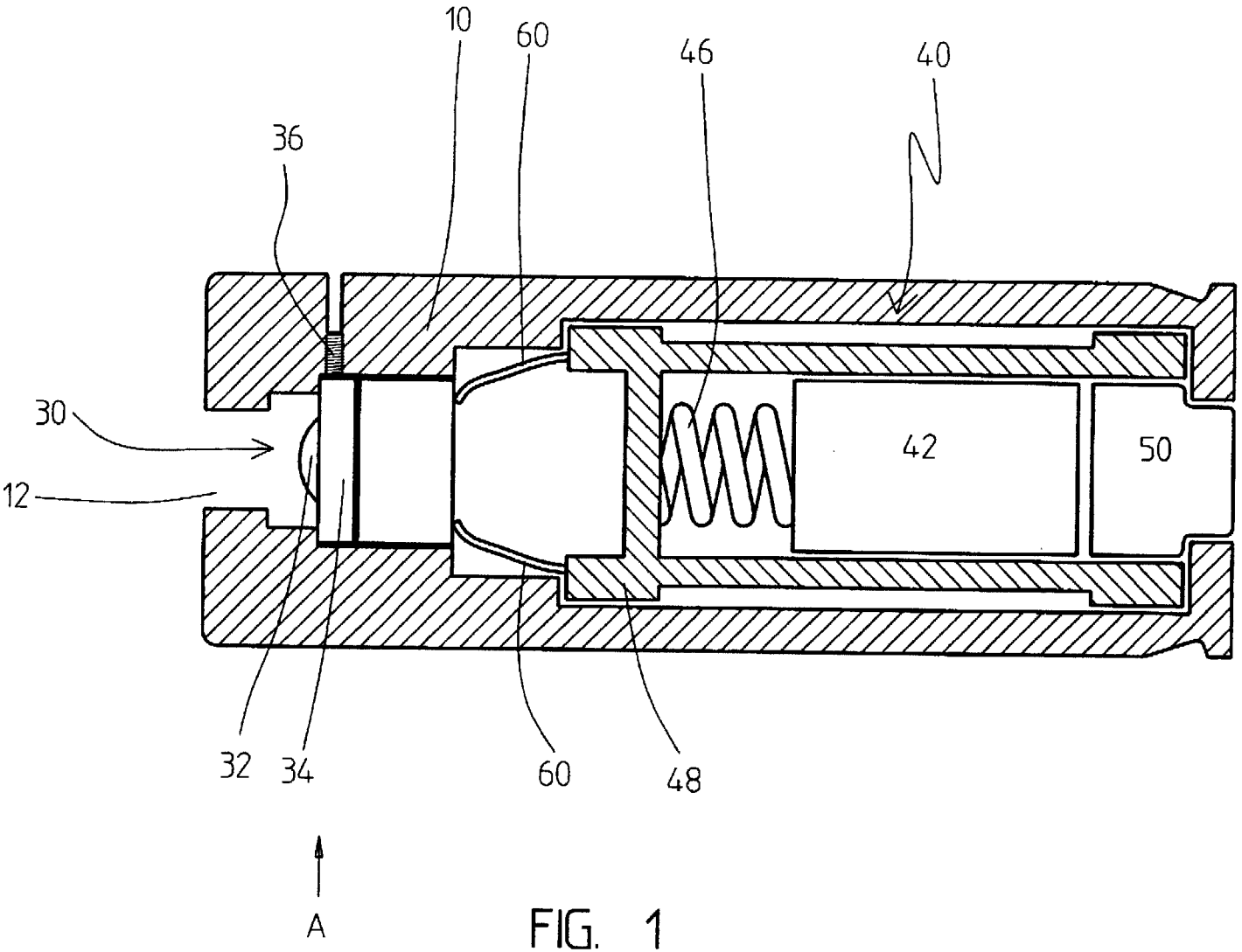
FIG. 1 is a longitudinal cross sectional view of a laser cartridge.

Referring now to the drawings, FIG. 1 is a longitudinal cross section of a preferred embodiment of a laser cartridge. A housing 10 is made of a rigid material, such as brass, in the form of a hollow cylinder substantially the same in outside dimensions as the munition cartridge of the gun that the laser cartridge is to be used with, so as to fit inside the chamber of that gun. Housing 10 is open at its front end via a port 12. A diode laser 20 emits electromagnetic radiation via a lens 32 and port 12. Among the diode lasers suitable for this application are the class IIIa lasers manufactured by Laser Devices, Inc., of Monterrey Calif. Lens 32 is held inside a bezel 34. Together, lens 32 and bezel 34 constitute a collimator 30. A generator 40 contains a permanent magnet 42 and a spring 46 within a bobbin 48. Bobbin 48 is made of an insulating material, for example lexan. Wrapped around bobbin 48 is a coil 44 (not shown). The ends of coil 44 connect to wires 60 which connect diode laser 20 electrically to generator 40. Magnet 42 slides within bobbin 48 when pushed by a pin 50 and spring 46.

The laser cartridge is loaded into a gun just like an ammunition cartridge. When the gun is fired, the firing mechanism of the gun thrusts the firing pin of the gun against pin 50, sliding magnet 42 through coil 44, thereby inducing an electric current in coil 44. This electric current is conducted by wires 60 to diode laser 20, causing diode laser 20 to emit a pulse of electromagnetic radiation. At the same time, spring 46 is compressed. When the firing mechanism withdraws the firing pin, spring 46 pushes magnet 42 back through coil 44, inducing an opposite electric current that prolongs the pulse of electromagnetic radiation.

Generator 40 must be designed so that the current induced in coil 44 is not so strong as to bum out laser diode 20. This can be accomplished by designing bobbin 48 with a suitable interior length and spring 46 with a suitable stiffness.

Figure 2:
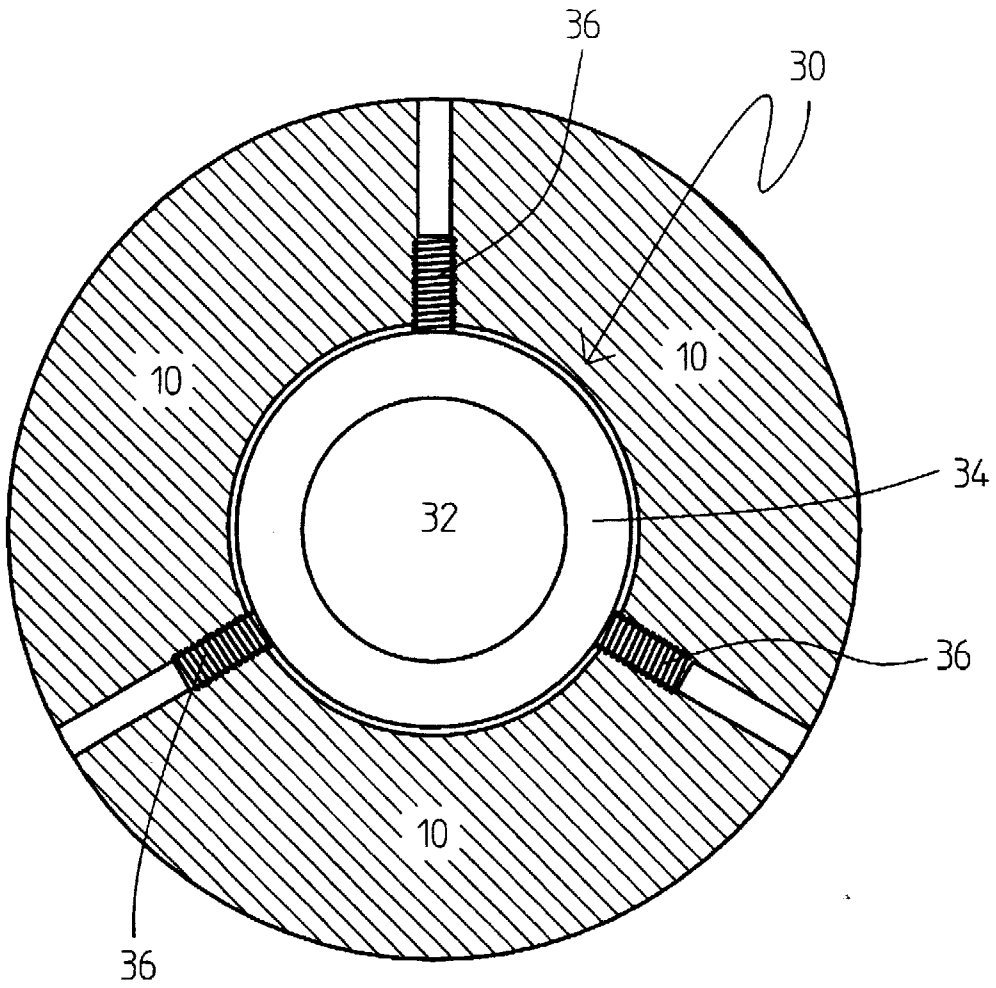
FIG. 2 is a transverse cross section of a laser cartridge showing the collimator.

FIG. 2 is a cross sectional view of the laser cartridge along line A—A of FIG. 1, showing how collimator 30 is adjustably mounted inside housing 10, to make sure that the beam of electromagnetic radiation emitted by the laser cartridge travels substantially along the longitudinal axis of the laser cartridge. Screws 36 are threaded through threaded holes in housing 10 and are in contact with collimator 30. The position of collimator 30 is adjusted by turning screws 36. Alternatively, housing 10 can be machined with sufficient precision to guarantee that collimator 30 is aligned correctly.

Figure 3:
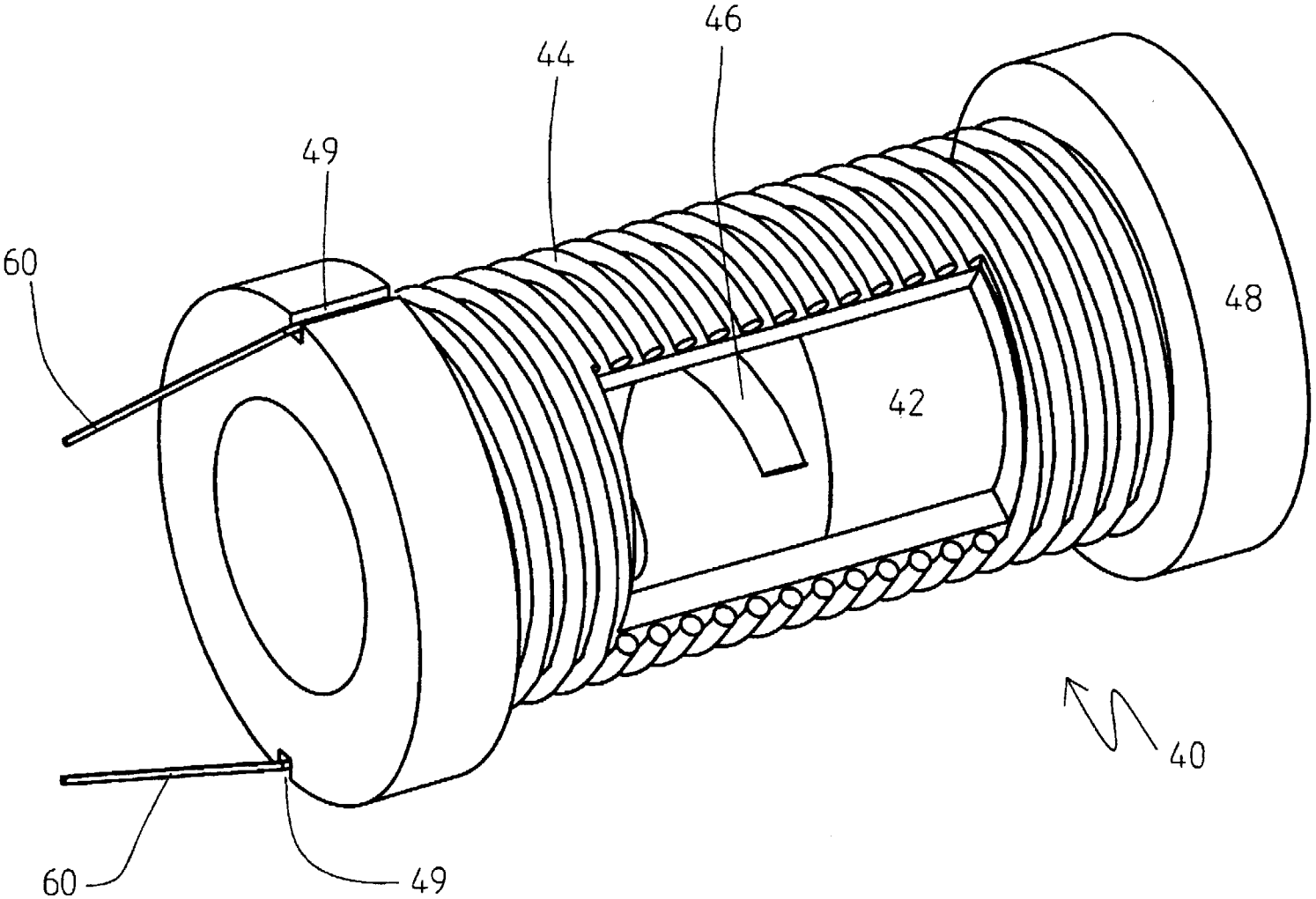
FIG. 3 is a partially cut away perspective view of the generator.

FIG. 3 is a partially cut away perspective view of generator 40, showing how coil 44 is wound around bobbin 48. The ends of coil 44 run into wires 60 via grooves 49 in the periphery of the front end of bobbin 48. In the most preferred embodiment of the laser cartridge, coil 44 consists of 600 turns of AWG 38.5 wire, far more turns than are shown in FIG. 3. The cut-away view shows magnet 42 and spring 46 inside bobbin 48.

While the invention has been described with respect to a limited number of embodiments, it will be appreciated that many variations, modifications and other applications of the invention may be made.

What is claimed is:

1. A laser cartridge for a gun that fires an ammunition cartridge, the gun having a firing mechanism, comprising:

(a) a rigid housing, substantially the same size and shape as the ammunition cartridge, said housing having a front end;

(b) a source of coherent electromagnetic radiation, contained within said housing; and (c) a power supply contained within said housing and electrically connected to said source of coherent electromagnetic radiation, said power supply being activated by the firing mechanism of the gun, said power supply including a generator.

2. The laser cartridge of claim 1, wherein said source of coherent electromagnetic radiation is a laser.

3. The laser cartridge of claim 2, wherein said laser is a diode laser.

4. The laser cartridge of claim 1, wherein said housing has a port in said front end and wherein said source of coherent electromagnetic radiation is oriented to shine said radiation through said port.

5. The laser cartridge of claim 1, wherein said power supply includes a battery.

6. The laser cartridge of claim 1, where said generator includes a coil and a magnet, said coil being rigidly attached to said housing, said magnet being movably attached to said housing, such that the firing mechanism of the gun moves said magnet through said coil, thereby generating an electric current.

7. The laser cartridge of claim 6, wherein said generator includes a biasing mechanism disposed to oppose said motion imparted to said magnet by the firing mechanism.

8. The laser cartridge of claim 7, wherein said biasing mechanism includes at least one spring.

9. The laser cartridge of claim 1, wherein said electromagnetic radiation is infrared radiation.

10. The laser cartridge of claim 1, wherein said electromagnetic radiation is visible light.

11. The laser cartridge of claim 1, wherein said electromagnetic radiation is ultraviolet light.

12. The laser cartridge of claim 1, further comprising a collimator contained within said housing, said collimator being positioned so that said coherent electromagnetic radiation passes through said collimator.

13. The laser cartridge of claim 12, wherein said collimator includes at least one lens.

14. The laser cartridge of claim 12, wherein said collimator is adjustably mounted within said housing.

15. The laser cartridge of claim 14, wherein said means for adjustably mounting said collimator includes a plurality of screws threaded radially through said housing.

* * * * *